US005137611A

United States Patent [19]

Roberts et al.

[11] Patent Number: 5,137,611

[45] Date of Patent: Aug. 11, 1992

[54] ELECTROLYTIC PLATING ONE SURFACE OF CONDUCTIVE SHEET

[75] Inventors: Timothy R. Roberts, Middletown; Julie A. Heitzenrater, Monroe; Larry E. Parrella; Donald H. Ward, both of Middletown, all of Ohio

[73] Assignee: Armco Inc., Middletown, Ohio

[21] Appl. No.: 786,868

[22] Filed: Nov. 1, 1991

[51] Int. Cl.[5] ..... C25D 17/00

[52] U.S. Cl. ..... 204/206

[58] Field of Search ..... 204/206

[56] References Cited

PUBLICATIONS

Influence of Electrolyte on the Electrodeposition of Zinc-Alloy, Trans. ISIJ, vol. 26, 1986, pp. 53-60, Tetsuaki Tsuda.

The Interaction Between Electrogalvanized Zinc Deposit Structure and the Forming Properties of Steel Sheet, Plating and Surface Finishing, vol. 76, No. 3, Mar. 1987, pp. 62-70, J. H. Lindsay et al.

High Current Density Electroplating of Zinc Nickel and Zinc-Iron Alloys, Plating and Surface Finishing, vol. 76, No. 3, Jul. 1986, pp. 68-73, A. Weymeersch et al.

*Primary Examiner*—T. M. Tufariello

*Attorney, Agent, or Firm*—R. J. Bunyard; L. A. Fillnow; R. H. Johnson

[57] ABSTRACT

Apparatus for horizontally plating one surface of conductive sheet with a metal or metal alloy. The apparatus includes an electrolyte holding tank, a horizontally disposed enclosed electrolyte conduit having extended inlet and outlet portions, a variable speed pump for passing electrolyte from the holding tank through the conduit and a rectifier for supplying electrical current. The holding tank includes means for dissipation of entrapped gas bubbles generated during metal deposition or caused by aeration. The conduit has a horizontal opening including an insoluble anode within the opening for defining a plating cell. The anode is positioned parallel to the axis of the conduit and in alignment with the opening. The plating cell includes means for supporting the sheet above the opening. The inlet and outlet portions of the conduit are positioned in-line with the plating cell. The inlet portion has a cross sectional area greater than the cross sectional area of the plating cell and is positioned sufficiently upstream of the plating cell so that electrolyte is stabilized when flowing between the anode and the sheet. Only the bottom surface of the sheet is exposed to electrolyte flowing through the conduit.

15 Claims, 7 Drawing Sheets

ELECTROLYTIC PLATING ONE SURFACE OF CONDUCTIVE SHEET

BACKGROUND OF THE INVENTION

This invention relates to apparatus for electrolytic plating one surface of a conductive sheet with a metal or metal alloy. More particularly, the invention relates to apparatus wherein electrolyte pumped through a horizontal plating cell is uniform and stable and gas evolved during metal deposition and aeration is dissipated at high electrolyte flow rates.

It is known to use apparatus for horizontally plating only the bottom surface of steel sheet with a metal or metal alloy. One such prior art apparatus includes an electrolyte holding tank, a horizontally disposed electrolyte conduit having an open electroplating cell, the plating cell including an insoluble plating anode and means for supporting the sheet above the opening and a pump for flowing electrolyte from the tank through the conduit. The anode is positioned on the bottom of the conduit in alignment with the plating cell opening. However, the apparatus is only capable of low electrolyte flow rates and is unable to provide a smooth metal coating having a uniform thickness.

Apparatus for vertically metal plating one surface of steel sheet also is known. The flow rate cannot be regulated, however, because electrolyte flow in this type plating apparatus is by gravity. More importantly, this type plating apparatus generally requires electrolyte flow to be discontinued and the apparatus to be disassembled when removing a plated sheet from the plating cell.

Accordingly, there remains a need for an electrolytic plating apparatus that provides for easy placement and removal of a conductive sheet from a plating cell without interrupting the electrolyte flow. Furthermore, there remains a need for an electrolytic plating apparatus that permits high electrolyte flow rates and a smooth metal coating having a uniform thickness.

BRIEF SUMMARY OF THE INVENTION

The invention relates to an apparatus for horizontally plating one surface of a conductive sheet with a metal or metal alloy. The apparatus includes a tank having first and second chambers for holding electrolyte, means for dissipation of gas bubbles from the electrolyte, a horizontally disposed enclosed conduit having in-line inlet and outlet portions, means for pumping the electrolyte from the second chamber through the conduit and means for supplying electrical current to a plating cell. The conduit includes an opening, an insoluble plating anode disposed within the conduit below the opening and parallel to the axis of the conduit and means for sealing and supporting a conductive sheet above the opening. The spacing between the upper surface of the anode and the opening defines the plating cell. The inlet is positioned an extended distance upstream of the plating cell and has a cross sectional area greater than the cross sectional area of the plating cell. Electrolyte is stabilized when passed between the anode and the sheet.

Preferred embodiments of the apparatus include the spacing between the anode and the conduit opening being 2–15 mm and the distance between the inlet and the plating cell being least 20 cm. The dissipation means may include a baffle positioned between the two chambers and the cross sectional area of the conduit discharge outlet being greater than the cross sectional area of said plating cell. The inlet may be as much as 100% wider than the width of the plating cell.

A principal object of the invention includes a plating apparatus allowing placement and removal of a conductive sheet from an electrolytic cell without interrupting electrolyte flow.

Another object includes a plating apparatus permitting high electrolyte flow rates.

Advantages of the invention include easy placement and removal of a conductive sheet from an electrolytic cell and use of small volumes of electrolyte with no adverse effects from cavitation or air entrapment at high flow rates.

DETAILED DESCRIPTION OF THE PREFERRED EMBODIMENT

Figure 1:
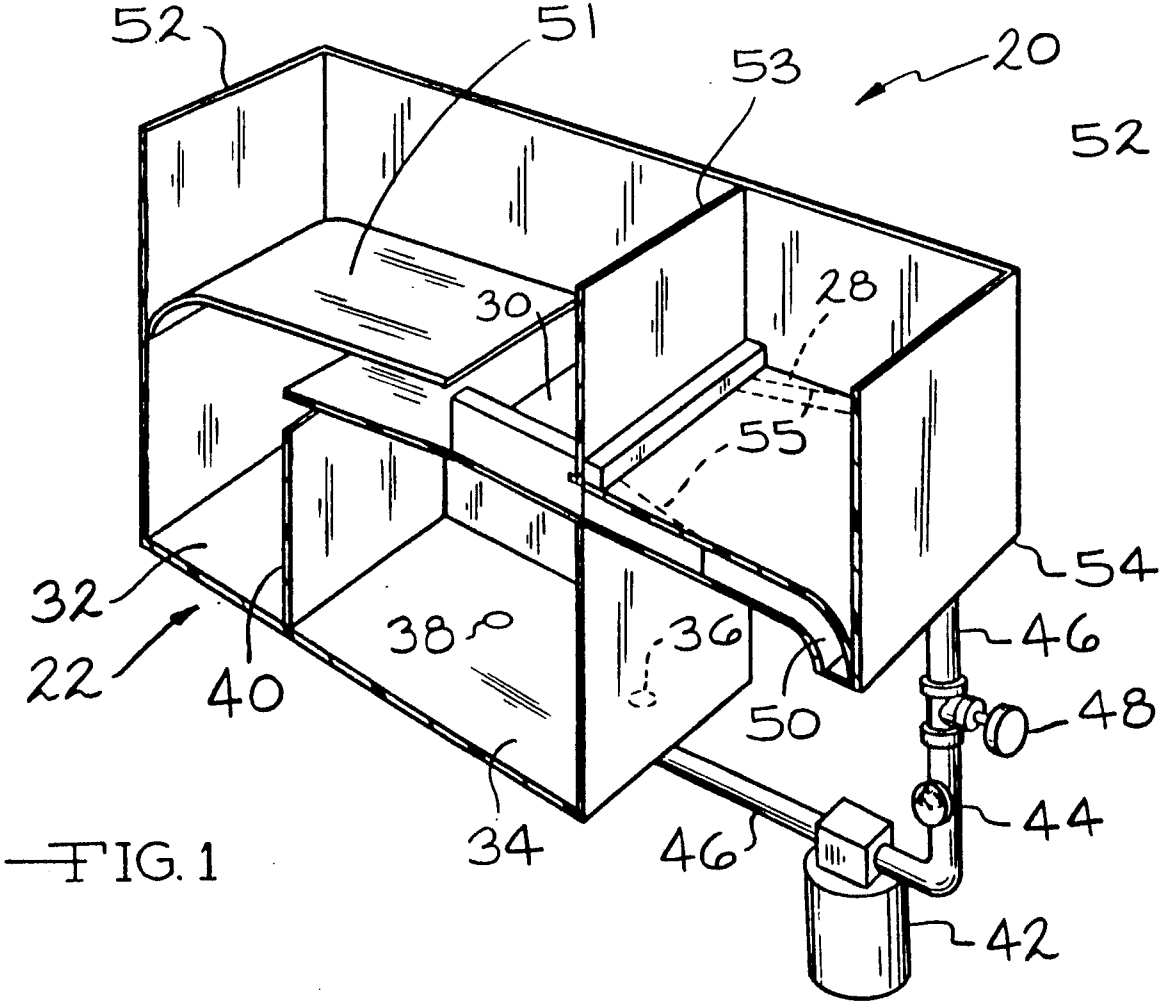
FIG. 1 is a perspective view of an electrolytic apparatus of the invention for plating one side of a conductive sheet with metal or metal alloy.
Figure 2:
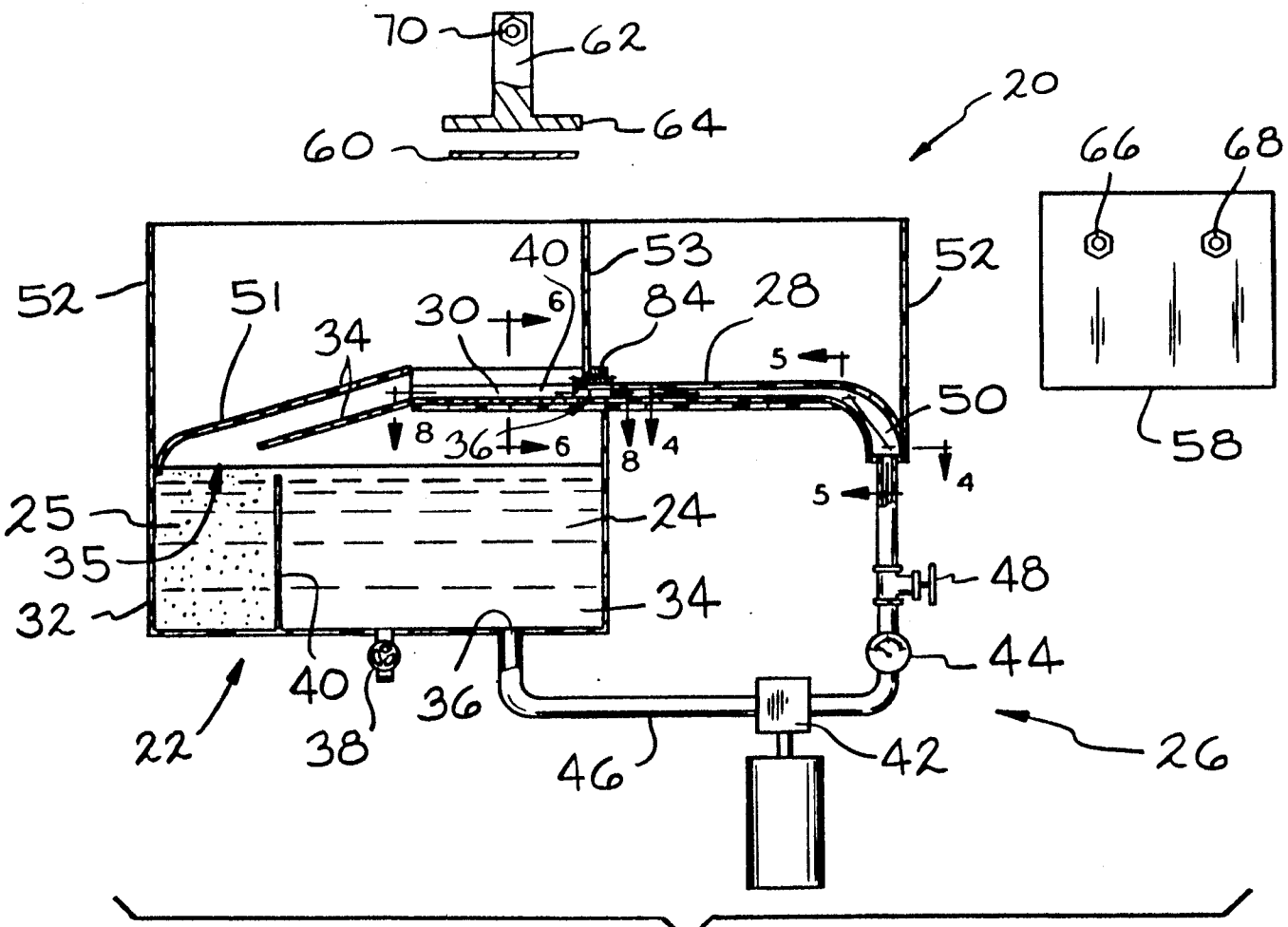
FIG. 2 is an elevation view, partially in section, of the electrolytic apparatus of FIG. 1.
Figure 3:
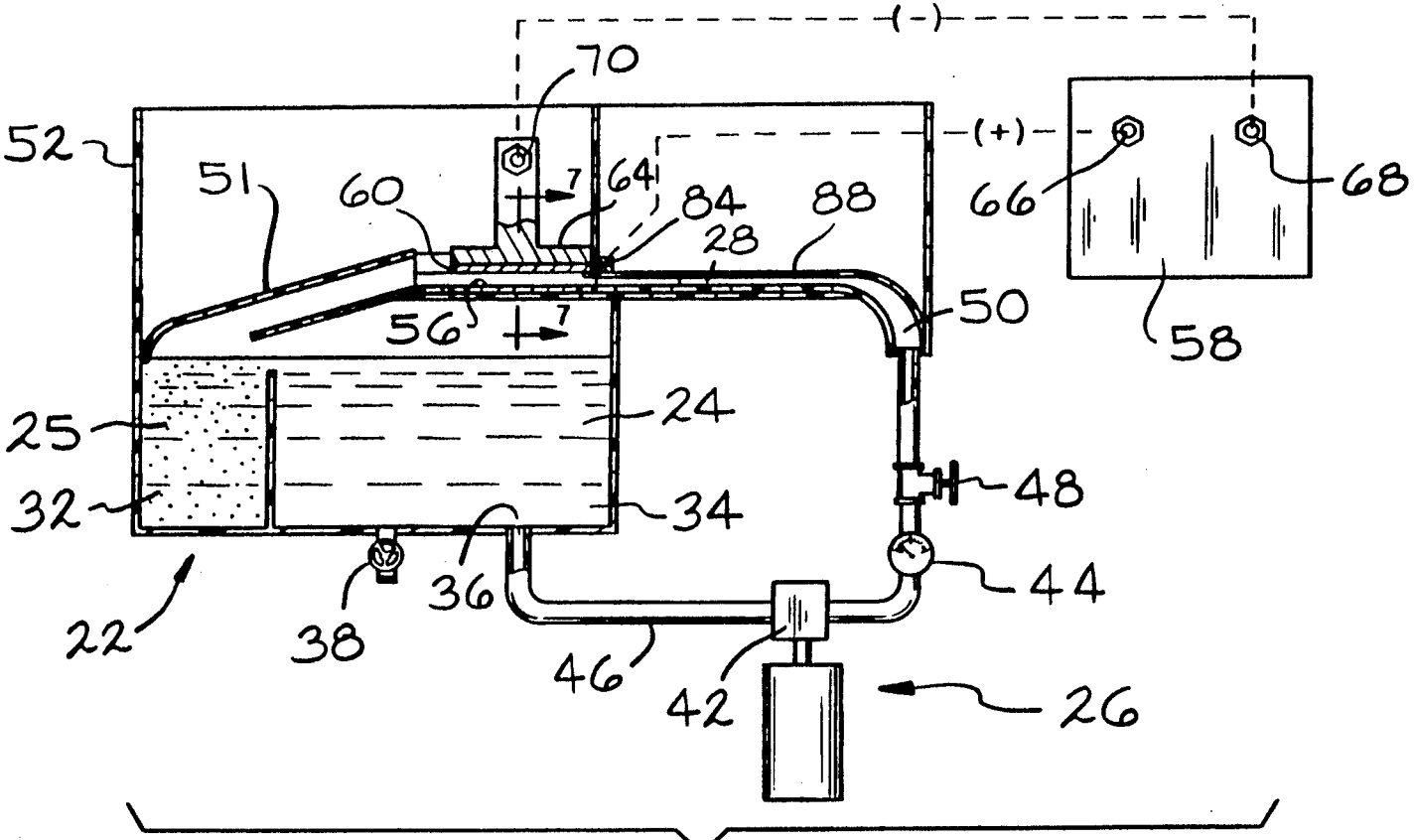
FIG. 3 is a view similar to FIG. 2 illustrating the conductive sheet positioned within the electrolytic cell being plated with a metal or a metal alloy.

Reference numeral 20 of FIGS. 1–3 generally illustrates an apparatus for horizontally plating one surface of a conductive sheet with a metal or metal alloy. Apparatus 20 includes a tank 22 for holding an electrolyte 24, means 26 for delivering the electrolyte to an enclosed conduit 28 generally rectangular in cross section and a plating cell 30. Holding tank 22 includes a first chamber 32 for receiving electrolyte discharged from conduit 28 and a second chamber 34. Chamber 34 includes a drain 38 and an outlet 36. Chambers 32 and 34 are separated by an upstanding baffle 40 extending up to near the upper surface of electrolyte 24 for dissipation of gas bubbles 25 generated during metal deposition and aeration of the electrolyte. Conduit 28 includes an in-line inlet 50 and in-line flared discharge outlet 51 for discharging electrolyte into chamber 32. Delivery means 26 includes a variable speed pump 42 for withdrawing electrolyte 24 from chamber 34 through outlet 36 and pumping the electrolyte through a pipe 46, a flow meter 44, a flow regulating valve 48 and then into inlet 50 of conduit 28. Conduit 28 is structurally supported above tank 22 by outer upstanding walls 52 and an inner upstanding wall 53.

FIG. 2 illustrates a conductive sheet 60 such as steel, a sheet holder 62 having a planar bottom 64 and a rectifier 58 for supplying electrical current. Rectifier 58 includes a positive terminal 66 for connection to an anode and a negative terminal 68 for connection to a terminal 70 on holder 62.

FIG. 3 illustrates one embodiment with sheet 60 positioned over plating cell 30. Bottom 64 of holder 62 preferably is a magnet for magnetically holding sheet 60 although vacuum or mechanical means could be used. The positive terminal 66 on rectifier 58 is connected to a plating anode 56 and the negative terminal 68 on rectifier 58 is connected to terminal 70 on holder 62 with the bottom of the sheet being plated with a metal or a metal alloy. Anode 56 may be made from various known conductive but insoluble materials such as a titanium sheet having an iridium oxide coating.

Figure 4:
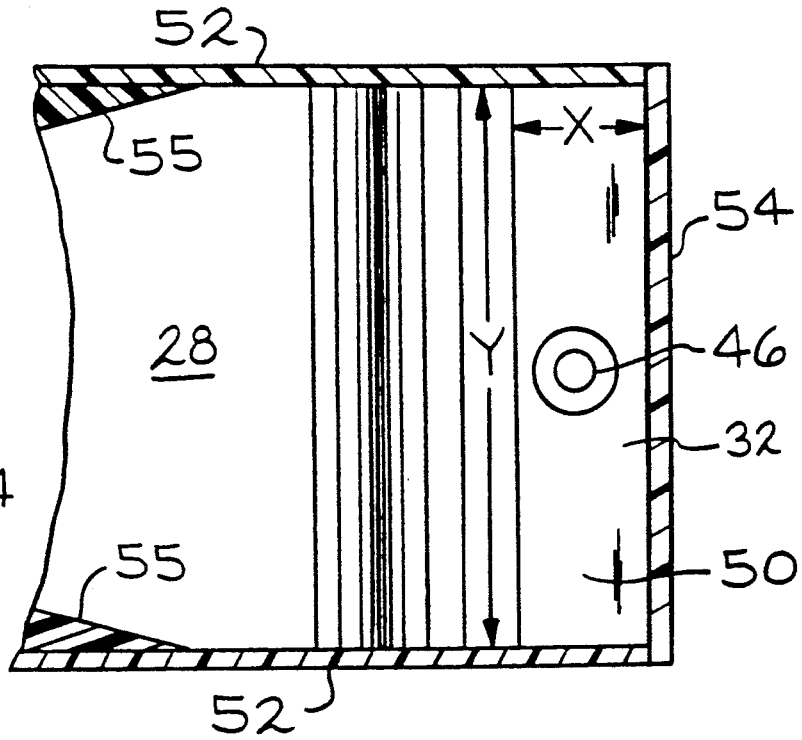
FIG. 4 is a fragmentary sectional view along line 4—4 of FIG. 2 illustrating the inlet of the electrolyte conduit.
Figure 5:
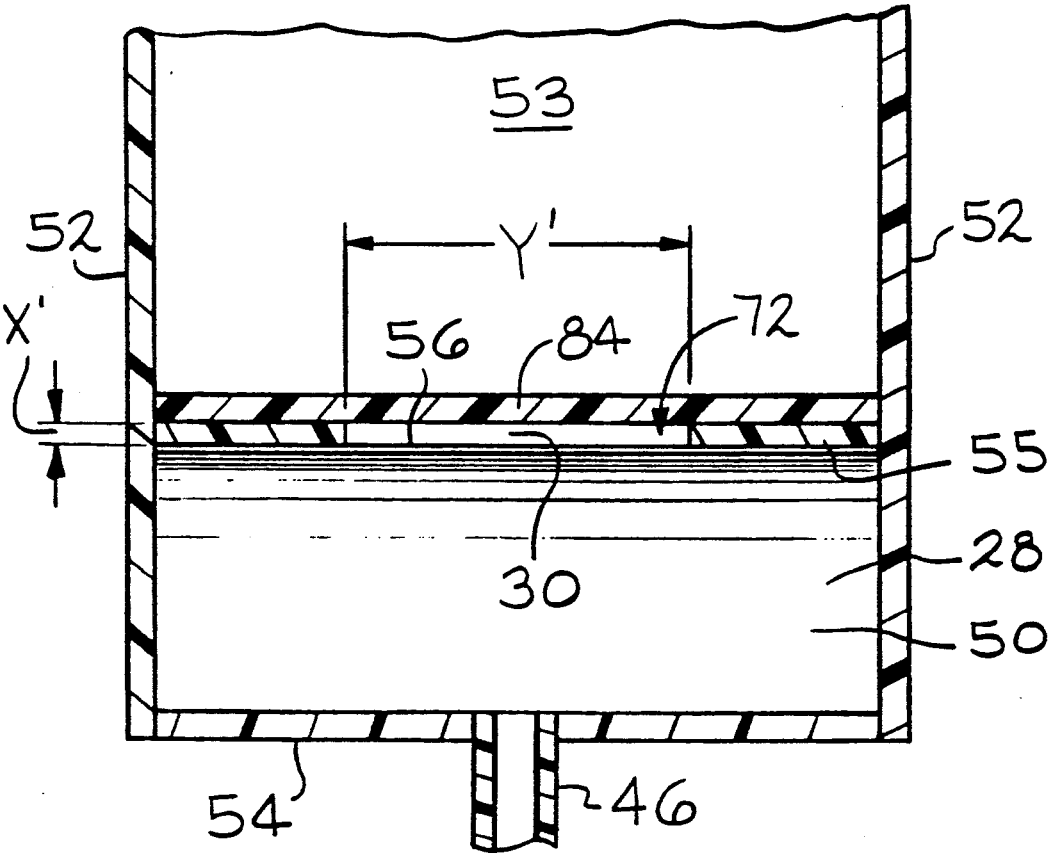
FIG. 5 is a fragmentary sectional view along line 5—5 FIG. 2 illustrating the inlet of the electrolyte conduit.
Figure 8:
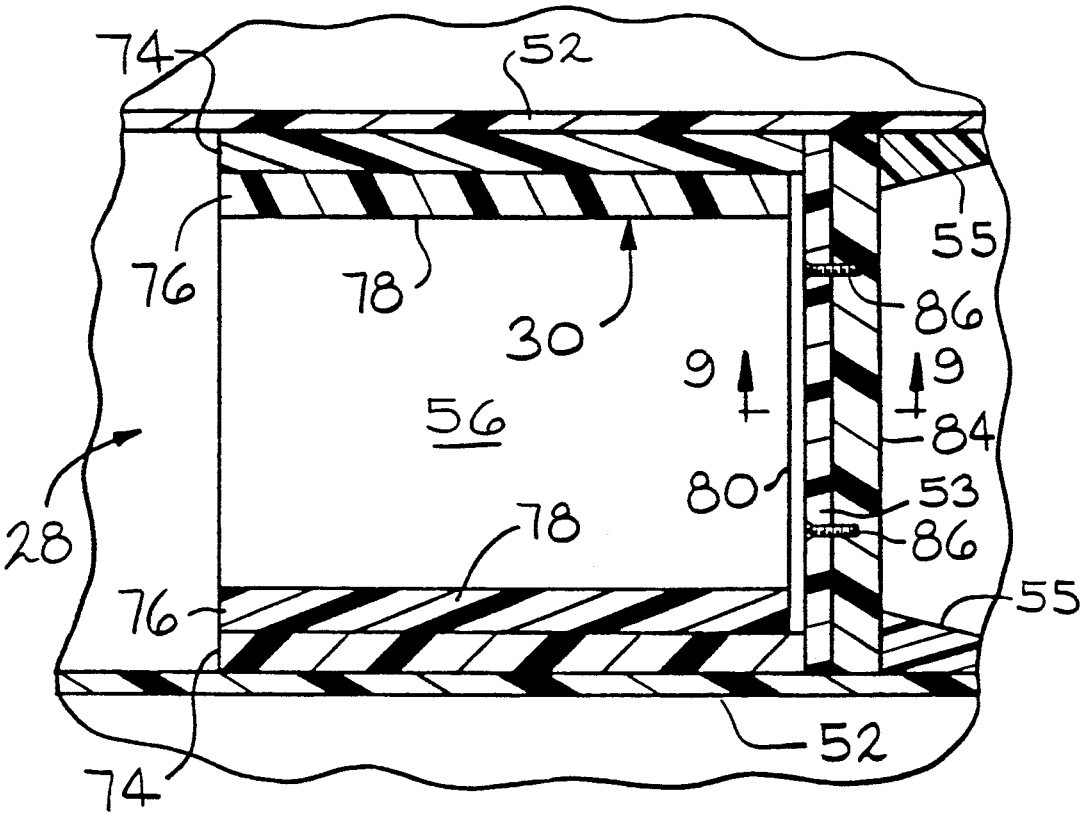
FIG. 8 is a fragmentary plan view illustrating the electrolytic plating cell.

FIGS. 4 and 5 illustrate that the bottom 54 of inlet 50 has a cross sectional area substantially greater than the cross sectional area of opening 72 of plating cell 30. That is, inlet 50 has a smooth reduction in dimension on each side in the direction of opening 72. The dimension x of bottom 54 of inlet 50 is reduced by gradually being tapered to dimension x' corresponding to the height of opening 72 of plating cell 30. The dimension y of bottom 54 of inlet 50 also is reduced by gradually being tapered to dimension y' corresponding to the width of opening 72 of plating cell 30 by positioning triangular members 55 adjacent to outside walls 52 immediately ahead of opening 72 of plating cell 30 (FIG. 8). The included angle members 55 form with each outside wall 52 of the embodiment shown is about 30°.

Figure 6:
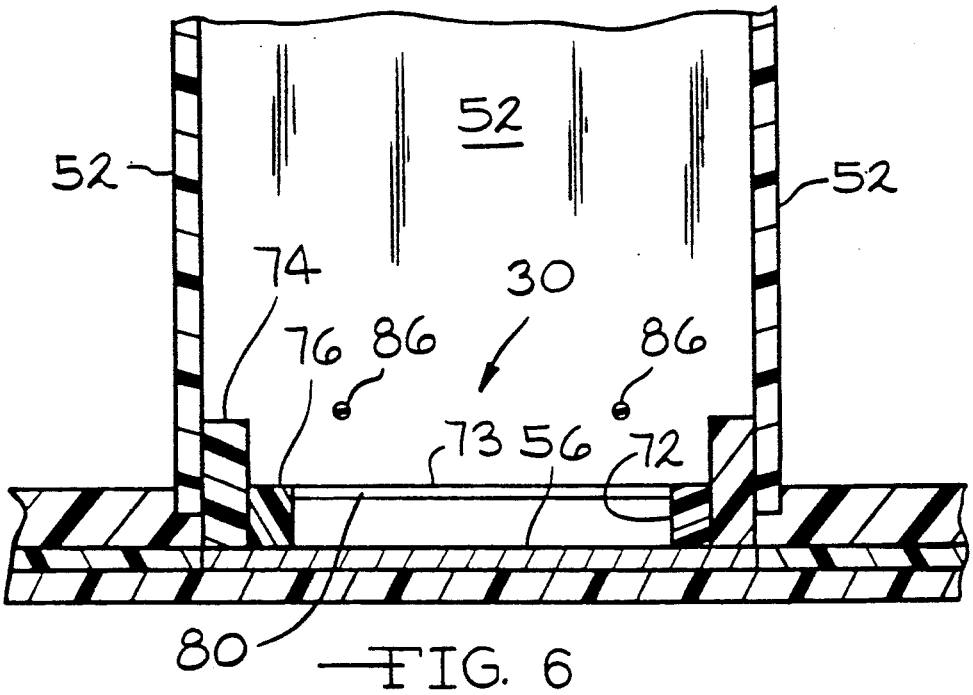
FIG. 6 is a fragmentary sectional view along line 6—6 of FIG. 2 illustrating means for supporting a conductive sheet above an electrolyte plating cell.
Figure 7:
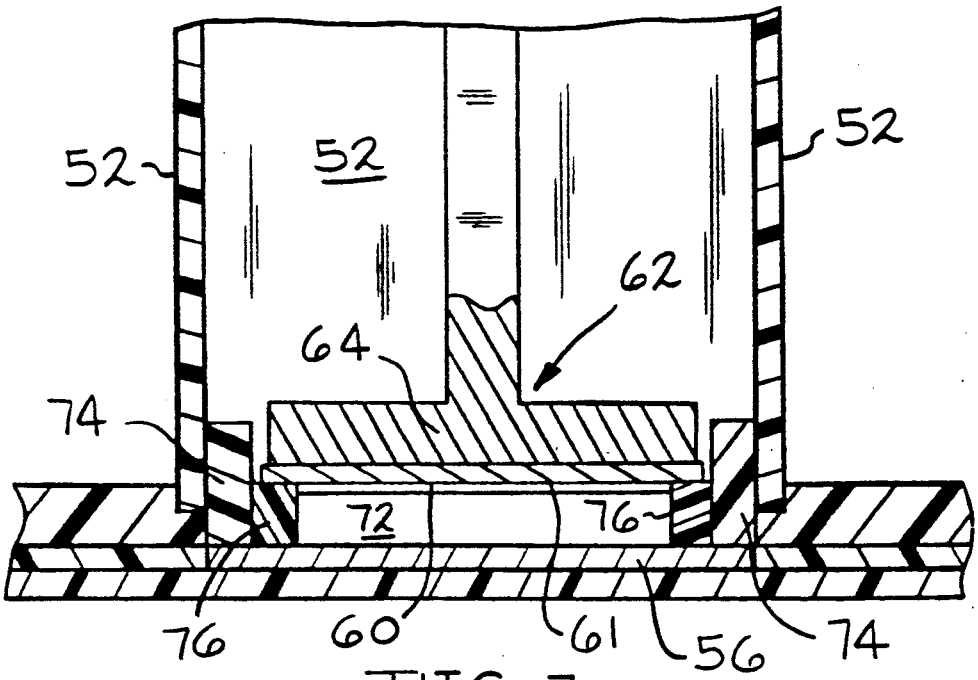
FIG. 7 is a fragmentary sectional view along line 7—7 of FIG. 3 illustrating the conductive sheet being electroplated with a metal or a metal alloy.

FIG. 6 illustrates details of plating cell 30. Plating cell 30 includes anode 56 positioned parallel to the axis, preferably on the bottom, of conduit 28. The spacing between the upper surface of anode 56 and the upper surface 73 of conduit 28, i.e., opening 72, defines the distance which electrical current passes through flowing electrolyte causing metal to be plated onto the bottom surface 61 of sheet 60. The height of opening 72 is in the range of about 2–20 mm with 2–15 mm being preferred. The minimum height to prevent arcing between sheet 60 and anode 56 is about 2 mm. The height through which current can be passed efficiently and at which point the supply of electrolyte required to be supplied by pump 42 becomes excessive is about 15 mm. Plating cell 30 further includes means 76 for supporting the conductive sheet so that only bottom surface 61 of sheet 60 is exposed to electrolyte passing through conduit 28 and a means 74 for guiding sheet 60 and holder 62 to the predetermined position over plating cell 30 illustrated in FIG. 7.

FIG. 8 shows in detail support means 76. Support means 76 includes a member 78 extending longitudinally on both sides the full length of plating cell 30 for supporting both sides of the sheet and a lip 80 extending transversely across the plating cell 30 for supporting one end of the sheet. The force of holder 62 is sufficient to cause the peripheral edges of bottom surface 61 of sheet 60 to tightly engage the upper surfaces of members 78, 80. This tight engagement provides a seal thereby preventing electrolyte from flowing around the edges and on top of the sheet. This insures that the electrolyte passing through opening 72 in conduit 28 only deposits coating metal onto bottom surface 61 of sheet 60.

Figure 9:
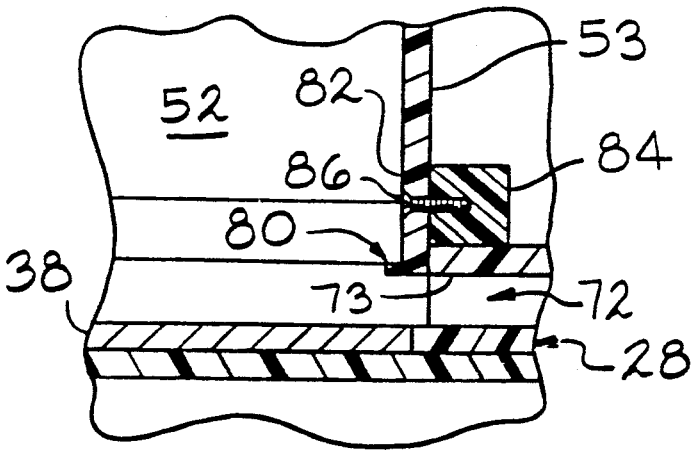
FIG. 9 is a sectional view along line 9—9 of FIG. 8 illustrating the transverse portion of the sheet support means.

FIG. 9 illustrates in detail transverse lip supporting member 80. Preferably, support means 76 provides for supporting member 80 to be mounted onto a removable wall portion 82 positioned snugly below wall 53. Wall portion 82 can be replaced when supporting member 80 becomes worn or damaged.

Figure 10:
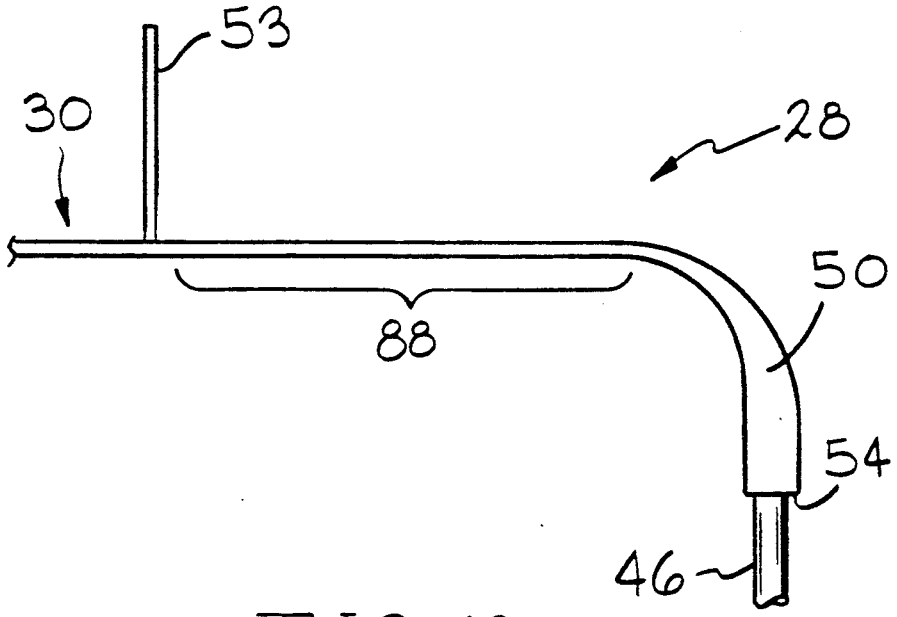
FIG. 10 is a plan view illustrating the inlet portion of the electrolyte conduit.

FIG. 10 illustrates conduit 28 has an extended horizontal span 88. That is, inlet 50 is positioned a substantial distance upstream of plating cell 30. Inlet 50 is gradually curved and tapered until horizontally in-line with opening 72 of plating cell 30.

As indicated above, inlet 50 of conduit 28 has a cross sectional area substantially greater than that of opening 72 in plating cell 30 of conduit 28. High rates of electrolyte flow, i.e., flow greater than two m/sec, generally have not been used for horizontal plating cells because plating can not occur when the electrolyte passing between the anode and the conductive sheet is disruptive or non uniform. We determined electrolyte pumped at these high rates became uniform and stable when passed through the plating cell if the inlet portion of the conduit had a cross section larger than the cross section of the plating cell and if this enlarged cross section portion of the conduit was positioned an extended distance upstream of the plating cell. Opening 72 of plating cell 30 became totally filled with electrolyte and the flow became uniform and stable when inlet 50 was positioned at least 20 cm ahead of opening 72 of electroplating cell 30 and the width of inlet 50 was increased at least 20% (y' to y). Preferably, the width of inlet 50 should be at least 50% wider and most preferably about 100% wider than the width of opening 72. By having the length of span 88 an extended distance, the included angle between member 55 and outside wall 52 can be sufficiently small so that the restriction formed is not abrupt. The included angle should be less than 45° and preferably no greater than 30°.

Additional novel features of the invention include baffle or weir 40 in holding tank 2, having discharge outlet 51 of conduit 28 an extended distance away from plating cell 30 and having conduit 28 having an increased height immediately down stream from plating cell 30 with the light gradually increasing or being flared in the direction of discharge outlet 51. Gases generated by metal deposition as well as by evolution at the anode become entrapped within the electrolyte. Gases also may be entrapped within the electrolyte when the electrolyte is exposed to the atmosphere during the period of time when a conductive sheet is not positioned over plating cell 30 as well as when passing through the discharge outlet portion of the conduit. Baffle 40 causes stirring of electrolyte 24 within chamber 32 prior to flowing over the top of the baffle into chamber 34 allowing the gas bubbles sufficient time to escape from the upper surface of the electrolyte. Electricity otherwise would not uniformly pass through the electrolyte in plating cell 30 if the gas bubbles remained entrapped in the electrolyte flowing through conduit 28 thereby causing poor coating quality on the conductive sheet. Chamber 32 of holding tank 22 also must have sufficient volume so that sufficient time is available for the gas bubbles to escape. Outlet 51 is positioned at least 25 cm downstream from plating cell 30 so that electrolyte being discharged from plating cell 30 will loose momentum and thus be readily directed into chamber 32 with minimum aeration and splashing. FIGS. 2 and 3 illustrate conduit 28 having an increased height immediately down stream from plating cell 30 with the height gradually increasing or being flared in the direction of discharge outlet 51. This increase in height also minimizes or eliminates any back pressure that otherwise might exist within conduit 28 caused by the restriction of conduit 28 between inlet 50 and opening 72 of plating cell 30. Eliminating back pressure prevents the electrolyte from flowing upwardly through plating cell 30 when a conductive sheet and the sheet holder are not positioned over the plating cell.

A laboratory plating apparatus similar to that illustrated in FIGS. 1–10 was used for plating one side of steel sheet with pure zinc. The apparatus was constructed using translucent acrylic sheet and the dimensions and capacities were as follows: the capacity of holding tank 22 was approximately 85 liters, the distance between inlet 50 and plating cell 30 (span 88) was 10 cm and the distance between plating cell 30 and discharge outlet 51 was 25 cm. The width and height of opening 72 were about 20 cm and 8 mm respectively and the corresponding dimensions of inlet 50 (distance y and x) were about 22 cm and 4 cm respectively. The electrolyte contained 120 g/l Zn, 5 g/l $H_2SO_4$ and was at a temperature of about 52° C. Low carbon steel sheets having a thickness of 0.7 mm, a width of 12.5 cm and a length of 21.5 cm were used. The steel sheets were alkaline cleaned and then rinsed with 50 g/l $H_2SO_4$.

EXAMPLE 1

In the initial trial, the long dimension of a cleaned steel sheet was positioned transversely onto plating cell 30. The electrolyte was pumped through conduit 28 and regulated to at least 2.0 m/sec by valve 48 and a current having a density of 100 A/dm$^2$ was passed through anode 56. Numerous gas bubbles were visually observed to be entrapped within the electrolyte. Electrolyte flow through plating cell opening 72 was not uniform. That is, electrolyte did not completely fill the cross section of plating cell opening 72 and continuously contact the entire bottom surface area of sheet 60. After 20 seconds, current flow was discontinued and electrogalvanized steel sheet 60 was removed from plating cell 30. The zinc coating had poor surface quality and a non uniform thickness.

EXAMPLE 2

In another trial, a cleaned steel sheet was electroplated in the same manner as described in Example 1 except the width of the plating cell was decreased to about 10 cm and the long dimension of the cleaned steel sheet was positioned parallel to the axis of conduit 28 when positioning over plating cell 30. Although gas entrapment was somewhat decreased, electrolyte flow through plating cell opening 72 still was non uniform and the coating quality was similar to that of Example 1. The abrupt change of conduit width immediately ahead of plating cell opening 72, e.g., 22 cm to 10 cm, was presumed to now have caused the non uniform electrolyte flow.

EXAMPLE 3

The next trial was conducted in a manner similar to that described in Example 2 except a pair of triangular members 55 was installed immediately ahead of plating cell 30 with one of the members being positioned adjacent to one wall 52 and the other of the members being positioned adjacent to the other wall 52. The included angle between each member and the outside wall was about 45°. It was hoped the triangular members would eliminate the non uniform electrolyte flow by providing a smoother transition in the conduit restriction immediately ahead of the plating cell opening. However, the results were similar to that reported for Example 2.

EXAMPLE 4

Another trial was conducted similar to that of Example 3 except the triangular members 55 were replaced with members having an included angle of about 30°. Although gas entrapment was not eliminated, electrolyte flow through the plating cell opening now was uniform. Reducing the angle caused a smooth transition as the electrolyte flowed from the enlarged inlet portion of the conduit through the restriction and then through the opening of the plating cell.

EXAMPLE 5

The next trial was conducted similar to that of Example 4 except the tank volume was increased to 120 liters. Entrapped gas was eliminated at electrolyte flow rates up to about 2 m/sec. However, gas bubbles remained entrapped when the flow rate was increased above 2 m/sec because the electrolyte did not remain within the holding tank for sufficient time before becoming recirculated. Electrolyte flow through the plating cell opening remained uniform until the flow rate was increased to about 3 m/sec.

EXAMPLE 6

The next trial was conducted similar to that of Example 5 except a baffle 40 was installed into tank 22 dividing the tank into chambers 32 and 34. The baffle positioned so that chamber 32 had a capacity of about 20 liters and chamber 34 had a capacity of about 100 liters (working volume remained 120 liters). Entrapped gas was eliminated at all electrolyte flow rates up to the capacity of pump 42, i.e., 7 m/sec, and electrolyte flow through plating cell opening 72 remained uniform up to electrolyte flow rates of about 3 m/sec. Gas bubbles formed during the electrodeposition of zinc or caused by aeration could visably be seen escaping from electrolyte 24 in chamber 32 prior to flowing over baffle 40 into chamber 34. Excessive splashing of the electrolyte from chamber 32 occured when flow rates exceeded about 3.5 m/sec.

EXAMPLE 7

The next trial was conducted similar to that of Example 6 except the distance between inlet 50 and plating cell 30 was increased from 10 cm to at least 20 cm, e.g., 21 cm. Electrolyte flow through the plating cell opening now remained uniform at all electrolyte flow rates up to the capacity of pump 42. After 20 seconds, current flow was discontinued and electrogalvanized steel sheet 60 was removed from plating cell 30. A zinc coating of 70 g/m$^2$ was formed on the sheet. The zinc coating was smooth, free of dendritic growth and had a uniform thickness.

EXAMPLE 8

The last trial was conducted in a manner similar to that of Example 7 except discharge outlet 51 of conduit 28 was extended from 25 cm to a position 50 cm downstream from opening 72 of plating cell 30. The height of conduit 28 also was flared or gradually increased in the direction toward discharge outlet 51 as shown in FIGS. 2 and 3. Splashing of the electrolyte from chamber 32 was eliminated.

As clearly demonstrated in the examples for horizontally electroplating one surface of a conductive sheet with a metal coating having a smooth surface and a uniform thickness, it is necessary to substantially reduce the cross sectional area of the plating cell opening from that of the inlet portion of the electrolyte conduit so that the electrolyte has sufficient head pressure to completely fill the plating cell opening. Furthermore, the enlarged inlet portion of the conduit must be positioned sufficient distance upstream ahead of the plating cell opening so that electrolyte flow through the plating cell opening is uniform. To minimize the distance the enlarged inlet portion must be positioned ahead of the plating cell, means may be used to provide a smooth transition at the point where the cross sectional area of the conduit is reduced.

It will be understood various modifications can be made to the invention without departing from the spirit and scope of it. For example, the bottom of the conductive sheet holder and the upper surface of the electrolyte conduit can have a non planar configuration. The upper portion of the conduit could be arcuate or cylindrical. The lower surfaces of the transverse sheet supporting member and the sheet holder would having corresponding curvatures. The size and shape of the electroplating cell can vary to accommodate various size and conductive sheet orientations. Therefore, the limits of the invention should be determined from the appended claims.

What is claimed is:

1. Apparatus for electrolytic plating one surface of a conductive sheet with metal or a metal alloy, comprising:

a tank for containing electrolyte, said tank provided with means for dissipation of gas bubbles from electrolyte, a horizontally disposed enclosed conduit having in-line inlet and outlet portions, means for pumping electrolyte from said tank through said conduit, said conduit including an opening, an insoluble plating anode disposed within said conduit and positioned parallel to the axis of said conduit, the spacing between the upper surface of said anode and said opening defining a plating cell, said inlet portion positioned an extended distance ahead of said plating cell and having a cross sectional area greater than the cross sectional area of said plating cell, means for sealing and supporting a conductive sheet above said opening whereby only the bottom surface of said sheet is exposed to electrolyte when flowing through said conduit, and means for supplying electrical current to said anode whereby electrolyte is stabilized when flowing through said plating cell.

2. The apparatus of claim 1 wherein said inlet portion is at least 20% wider than the width of said plating cell.

3. The apparatus of claim 1 wherein said cross sectional area of said inlet portion is at least 20% greater than said cross sectional area of said plating cell.

4. The apparatus of claim 1 further including means for providing a smooth transition at the point where said cross sectional area of said inlet portion is decreased.

5. The apparatus of claim 1 wherein said outlet portion has a cross sectional area greater than the cross sectional area of said plating cell.

6. The apparatus of claim 1 wherein said outlet portion has an increasing cross sectional area in a direction downstream from said plating cell.

7. The apparatus of claim 1 wherein said anode is positioned on the bottom of said conduit.

8. The apparatus of claim 1 wherein said spacing is 2–20 mm.

9. The apparatus of claim 1 wherein said spacing is 8 mm.

10. The apparatus of claim 1 wherein said dissipation means includes a baffle positioned within said tank.

11. The apparatus of claim 1 wherein said distance is at least 20 cm.

12. The apparatus of claim 1 wherein said support means includes a pair of longitudinally extending horizontal members positioned on opposite sides of said plating cell, said horizontal members connected by a transverse member.

13. The apparatus of claim 1 wherein said sheet is steel.

14. Apparatus for electrolytic plating one surface of a conductive sheet with metal or a metal alloy, comprising:

a holding tank having first and second chambers for containing electrolyte, said chambers separated by a baffle for dissipation of gas bubbles from electrolyte, a horizontally disposed enclosed conduit having in-line inlet and outlet portions, means for pumping electrolyte from said second chamber through said conduit, said conduit including an opening, an insoluble plating anode disposed on the bottom of said conduit within said opening, the spacing between the upper surface of said anode and said opening being 2–20 mm and defining a plating cell, said inlet portion positioned an extended distance ahead of said plating cell and having a cross sectional area greater than the cross sectional area of said plating cell, said cross sectional area of said inlet portion gradually decreasing in a direction toward said plating cell, means for sealing and supporting a conductive sheet above said opening whereby only the bottom surface of said sheet is exposed to electrolyte when flowing through said conduit, and means for supplying electrical current to said anode whereby electrolyte is stabilized when flowing through said plating cell.

15. Apparatus for electrolytic plating one surface of a conductive sheet with metal or a metal alloy, comprising:

a holding tank having first and second chambers for containing an electrolyte, said chambers separated by a baffle for dissipation of gas bubbles from electrolyte, a horizontally disposed enclosed conduit having in-line inlet and outlet portions, means for pumping said electrolyte from said second chamber through said conduit, said conduit including an opening, an insoluble plating anode disposed on the bottom of said conduit within said opening, the spacing between the upper surface of said anode and said opening being 2-20 mm and defining a plating cell, said inlet portion positioned at least 20 cm upstream of said plating cell and having a width at least 20% wider than the width of said plating cell, said width of said inlet portion gradually decreasing in a direction toward said plating cell, said outlet portion having a cross sectional area greater than the cross sectional area of said plating cell, means for sealing and supporting a conductive sheet above said opening whereby only the bottom surface of said sheet is exposed to electrolyte when flowing through said conduit, and means for supplying electrical current to said anode whereby electrolyte is stabilized when flowing through said plating cell.

* * * * *